US009808702B2

(12) United States Patent
Murphy et al.

(10) Patent No.: US 9,808,702 B2
(45) Date of Patent: Nov. 7, 2017

(54) ATHLETIC PROTECTION DEVICE

(71) Applicant: Russell Brands, LLC, Bowling Green, KY (US)

(72) Inventors: Timothy Errol Murphy, Scottsboro, AL (US); Daniel J. Cram, Encinitas, CA (US)

(73) Assignee: Russell Brands, LLC, Bowling Green, KY (US)

( * ) Notice: Subject to any disclaimer, the term of this patent is extended or adjusted under 35 U.S.C. 154(b) by 0 days.

(21) Appl. No.: 13/769,678

(22) Filed: Feb. 18, 2013

(65) Prior Publication Data

US 2014/0053325 A1 Feb. 27, 2014

Related U.S. Application Data

(62) Division of application No. 12/243,271, filed on Oct. 1, 2008, now abandoned.

(60) Provisional application No. 61/041,347, filed on Apr. 1, 2008.

(51) Int. Cl.

| | |
|---|---|
| ***A61F 5/00*** | (2006.01) |
| ***B29C 44/04*** | (2006.01) |
| ***A63B 71/12*** | (2006.01) |

(52) U.S. Cl.

CPC ..... *A63B 71/1216* (2013.01)

(58) Field of Classification Search

USPC ..... 264/45.1, 45.2, 45.6; 428/411.1, 315.7; 602/67–73; 128/845–846, 891, 95.1, 128/96.1; 2/425, 466

See application file for complete search history.

(56) References Cited

U.S. PATENT DOCUMENTS

| | | | |
|---|---|---|---|
| 3,782,375 | A | 1/1974 | Donars |
| 4,043,329 | A | 8/1977 | DiMatteo |
| 4,257,414 | A | 3/1981 | Gamm et al. |
| 4,453,541 | A | 6/1984 | Castelli et al. |
| 4,471,772 | A | 9/1984 | Miller, Jr. |
| 5,479,942 | A | 1/1996 | DiMatteo |
| 6,319,219 | B1 | 11/2001 | Landi |
| 6,859,948 | B2 | 3/2005 | Melts |
| 7,004,921 | B2 | 2/2006 | Littell |
| 7,296,307 | B2 | 11/2007 | Atwater et al. |
| 2003/0163076 | A1 | 8/2003 | Lukens |
| 2004/0024341 | A1 | 2/2004 | Jacobs |
| 2004/0092851 | A1 | 5/2004 | Littell |
| 2005/0268387 | A1 | 12/2005 | Wong |
| 2005/0278839 | A1 | 12/2005 | Atwater et al. |
| 2006/0212999 | A1 | 9/2006 | Byrd et al. |
| 2006/0229546 | A1 | 10/2006 | Littell |

*Primary Examiner* — Ophelia A Hawthorne
(74) *Attorney, Agent, or Firm* — Nathan W. Johnson; Jeremy A. Smith; Bradley Arant Boult Cummings LLP

(57) ABSTRACT

An athletic protector, such as an athletic cup, with regions formed of the same compositional material, which is more rigid in one such region than in another such region.

19 Claims, 2 Drawing Sheets

ATHLETIC PROTECTION DEVICE

CROSS-REFERENCE TO RELATED APPLICATIONS

This application claims the benefit of, and priority to U.S. application Ser. No. 12/243,271, now abandoned, filed Oct. 1, 2008 which in turn claims the benefit of, and priority to, U.S. Provisional Application No. 61/041,347, filed Apr. 1, 2008 titled "Improved Athletic Protection Device".

FIELD OF THE INVENTION

This invention relates to athletic protective devices and more particularly an improved athletic cup for protecting the genital/groin region, typically used by males. A method of manufacturing the improved athletic cup is also disclosed.

BACKGROUND ART

Devices protecting the human body against injury during strenuous physical activity, such as participation in sporting events, are well known in the art. A common protection device is an athletic "cup" designed to protect the genital/groin region from impact. For example, baseball players wear athletic cups to protect against injury, such as may occur if they were to be struck in the groin by a baseball while at bat.

Traditionally, athletic cups have been made of two or more pieces of different materials joined together in some manner. One of the purposes of the dual-component construction is to provide a soft or resilient structure adjacent the body of the wearer for comfort and/or impact absorption or dissipation, while retaining a hard shell to protect the genitals or groin. Most typically, the hard portion is a rounded cup-like structure having a central cavity. To this hard shell is typically affixed an outer ring of more flexible material for cushioning and comfort where the device seats against the body. These two components are typically of different composition, such as PVC, TPU, or other rigid plastic for the shell, with the flexible material being a foam, EVA, or a relatively soft rubber. These components may be joined by gluing, heat bonding, radio frequency welding, co-molding, or other techniques. In order to achieve both the protective effect of the hard shell and the comfort effect of the softer more resilient material, it is believed that typical prior athletic cups use two structures bonded during the manufacturing process for thereafter).

SUMMARY OF THE INVENTION

In some aspects, the invention relates to an athletic protector characterized by a structure in which a compositional material has a lower density at one location than the same material at another location. In a more detailed aspect of some embodiments, a compositional material of the athletic protector is less dense at a location worn near to, or facing toward, the body than it is at a location further from, or facing away from, the body. In another aspect, the athletic protector is characterized by a structure in which a compositional material is softer, or more resilient, or less rigid, at one location than the same material at another location. In a more detailed aspect of some embodiments, a compositional material of the athletic protector is softer or more resilient or less rigid at a location worn near to, or facing toward, the body than it is at a location further from, or facing away from, the body In other aspects, the invention relates to a method of creating an athletic protector having areas of different density, softness, resilience, or rigidity which areas are formed from basically the same compositional material.

Other aspects and advantages of the invention will be apparent from the following description and the appended claims.

BRIEF DESCRIPTION OF DRAWINGS

It should be noted that identical features in different drawings are shown with the same reference numeral.

DETAILED DESCRIPTION

The invention relates to an improved athletic cup for protecting the male genital/groin region and a method of manufacturing same. In an embodiment disclosed herein, the improved athletic cup is made of a single basic composition (i.e., one type of material). It may be molded into a single structure or component (i.e., one piece) and manufactured in a way such that it has varying degrees of hardness and flexibility at different regions. While the invention has been described with respect to a limited number of embodiments, those skilled in the art, having benefit of this disclosure, will appreciate that other embodiments can be devised which do not depart from the scope of the invention as discussed. Accordingly, the scope of the invention should be limited only by the claims as issued.

Figure 1:
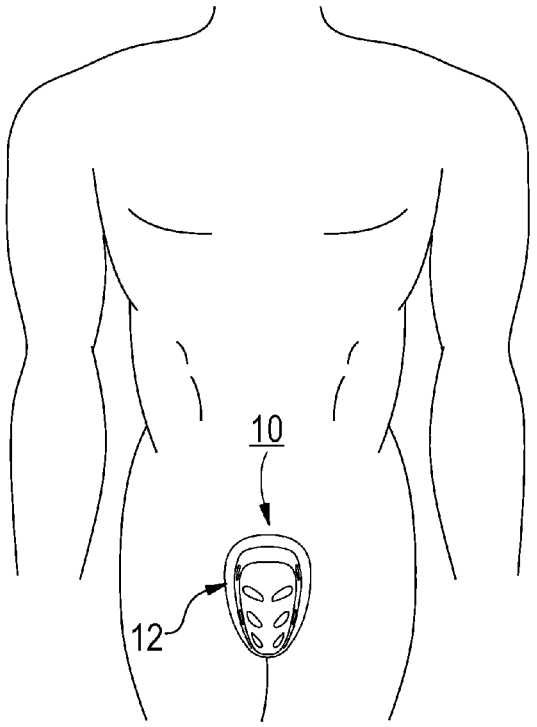
FIG. 1 shows a front view of the intended position of the improved athletic cup on the male body.
Figure 2:
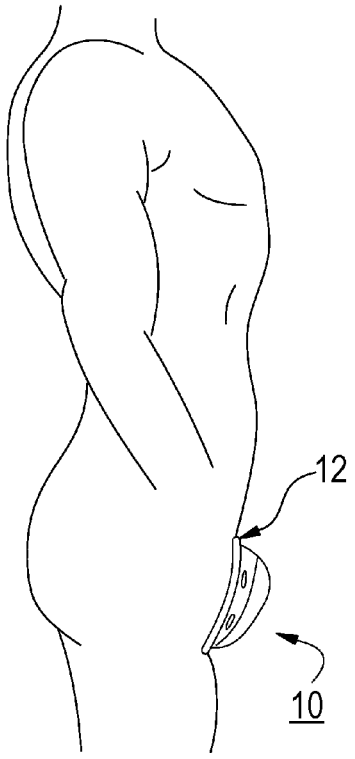
FIG. 2 shows a side view of FIG. 1.

FIGS. 1 and 2 illustrate an intended position of the improved athletic cup 10 when worn by a male athlete. A resilient comfort edge 12 is also shown where the improved athletic cup 10 contacts the wearer's body.

Figure 3:
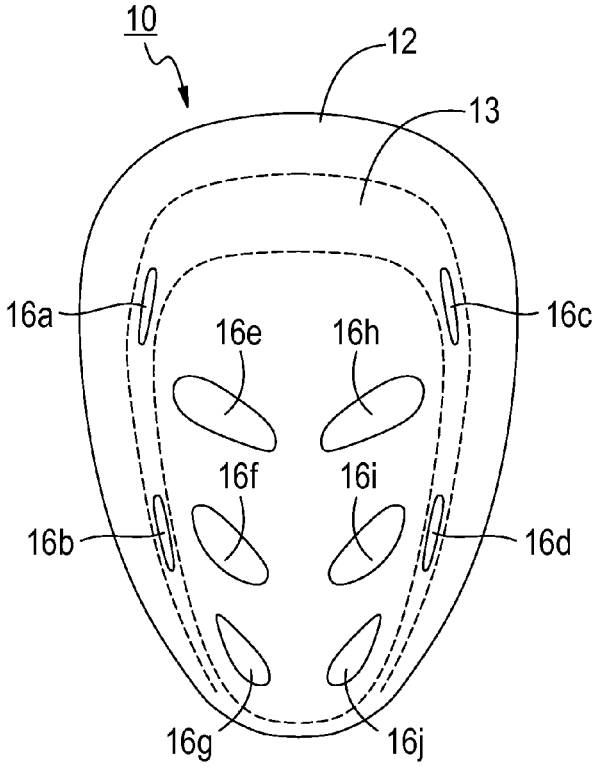
FIG. 3 shows a frontal view of the improved athletic cup.
Figure 4:
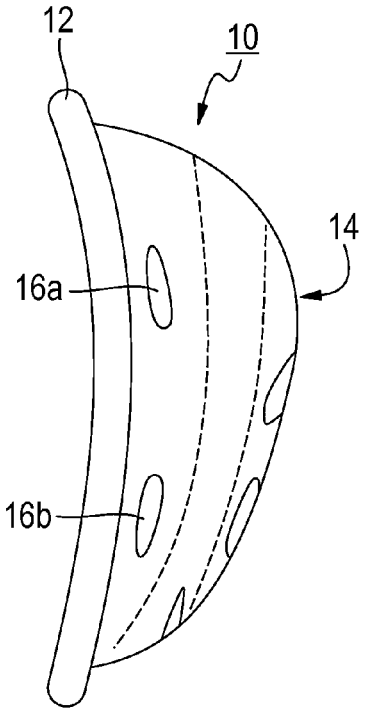
FIG. 4 shows a side view of the improved athletic cup.
Figure 5:
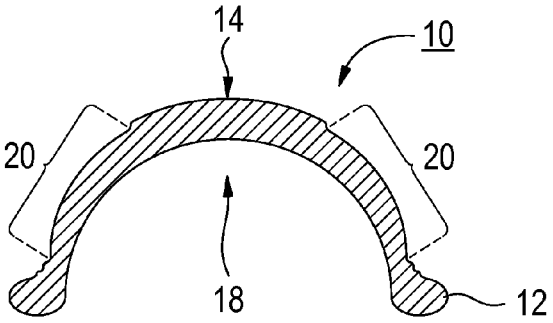
FIG. 5 shows a cross sectional view of the improved athletic cup.

One embodiment of the improved athletic cup 10 is depicted in FIGS. 3, 4 and 5. The improved athletic cup 10 has a frontal region 14 having a generally convex outer surface, outer regions 13, a generally concave inner surface 18 and a volume sufficient to enclose the wearer's genitals. The frontal region 14 possesses the necessary strength or hardness to withstand a blow to the genital/groin region without significantly deforming or collapsing, thereby protecting the sensitive region. In this particular embodiment the frontal region 14 is about 0.75 to 1.0 centimeters thick at its apex. Further, this embodiment has a resilient comfort edge 12 along the entire length of the contact or interface area between the improved athletic cup 10 and the wearer, in this particular embodiment the outer regions 13 include transitory regions 20 in which a transition from the "harder" material of the frontal region 14 to the "softer" resilient comfort edge 12 occurs. Transitory regions 20 that are gradient in nature (where the transition from "harder" material to "softer" material occurs gradually in indistinct steps) as well as step-like transitory regions 20 (where the transition from "harder" material to "softer" material occurs in one or more distinct steps, such that a line or small discrete juncture can be identified between areas of different hardness) are both within the scope of this disclosure. This embodiment also has a plurality of air vents 16*a* through 16*j*. Air vents 16*a* thru 16*d* are located directly above the resilient comfort edge 12. In this particular embodiment the improved athletic cup 10 has a total of ten air vents.

When the improved athletic cup 10 suffers a blow, for example by a baseball, the blow will generally occur in a nearly horizontal line to the frontal region 14. The frontal region 14 dissipates the force from the blow and redirects any remaining force away from the genital/groin region by transferring the force to the resilient comfort edge 12 and the transitory regions 20 thereby lessening or dampening the blow as well as transferring the force thereof to a less sensitive area of the wearer's body. The improved athletic cup 10 may be anatomically designed to contact the wearer's body with rounded edges and without any sharp corner intersections that could contact the wearer's body. If the improved athletic cup 10 is struck at an angle and force to be twisted there are no sharp corners to be forced into the wearer's body. In one embodiment, the athletic cup 10 can withstand of blow of approximately thirty five (35) pounds while providing sufficient protection to the wearer. The disclosure herein could of course be employed to provide a greater or lesser degree of protection.

In one embodiment, the improved athletic cup 10 is thicker at the apex of the frontal region 14 than at the outer regions 13 or transitory regions 20. The variation in thickness may be stepwise, or may be a smooth transition. The improved athletic cup 10 may be constructed with ridges (not shown) about its surface or a portion thereof, for cosmetic purposes or force-dissipation, or collapse-influencing purposes.

In another or the same embodiment, the improved athletic cup 10, inclusive of the frontal region 14 and the resilient comfort edge 12 is made of a single composition, for example Ethylene vinyl acetate copolymer (EVA). The use of EVA is particularly well-suited to the construction, as it facilitates constructing a rigid frontal region 14 that may, if desired, be characterized by an outer surface that is slightly compressible. This may serve to blunt the force of impact by an object and thereby cooperate with the effect of the resilient comfort edge 12. The EVA (or other compositional material) may be varied in density at different points on the improved athletic cup 10. In the shown embodiment, the apex of the frontal region 14 (and if desired the outer regions 13) is more dense than the resilient comfort edge 12. If desired, one may coordinate variations in density with variations in thickness, as discussed in the preceding paragraph, to further enhance the differences of the various areas of the cup in terms of resilience, resistance to impact, and/or comfort.

A method of manufacturing the improved athletic cup 10 is also disclosed. Generally, the athletic cup 10 is manufactured from a single compositional material in multiple steps including: (1) providing the compositional material, which may desirably be in a granulated form, (2) optionally coloring the compositional material, (3) forming the hard frontal region, (4) forming the resilient comfort edge, (5) joining the hard frontal region and the resilient comfort edge and (6) tempering the athletic cup.

In one embodiment the improved athletic cup 10 may be manufactured in the following manner:

(a) providing and optionally foaming the compositional material;

(b) forming the hard frontal region by introducing a first portion of a compositional material (for example, EVA or others) into a pre-heated mold at a frontal region forming temperature in which air has been removed from the mold and pressurizing the mold to a first pressure for a first time period;

(c) forming the resilient comfort edge by introducing a second portion of the compositional material into a pre-heated mold at a resilient comfort edge forming temperature in which air has been removed from the mold and pressurizing the mold to a second pressure for a second time period;

(d) bringing the mold containing the hard frontal region into contact with the mold containing the resilient comfort edge;

(e) joining the hard frontal region with the resilient comfort edge by exposing the molds to a fusing temperature at a third pressure for a third time period; and (f) tempering the athletic cup.

In one embodiment, the compositional material is EVA, the first portion of compositional material is added to a pre-heated mold at a frontal region forming temperature of about two hundred (200) degrees Celsius at eight (8) Pascals (Pa) of pressure for about two (2) minutes; the EVA melts in the hot mold and flows to the bottom side of the mold forming the harder frontal region 14 of the improved athletic cup 10, next, the second portion of compositional material to a pre-heated mold at a resilient comfort edge forming temperature of about three hundred (300) degrees Celsius at thirteen (13) Pa of pressure for approximately two (2) minutes; which after injection melts to form the resilient comfort edge 12. Then, the mold containing the frontal region and the mold containing the resilient comfort edge are brought into contact with one another. The molds are exposed to a fusing temperature of about one hundred seventy-five degrees (175) Celsius at a pressure of about thirteen (13) Pa for approximately four (4) minutes. The region of contact or interface between the deposit of compositional material introduced in the first form and the deposit of compositional material introduced in the second form forms the transitory regions 20. Finally, the fully formed improved athletic cup 10 is tempered.

In another embodiment, the compositional material is EVA, in one embodiment being granular EVA of a density of about 75 kg/m$^3$ (hereinafter the measure of the density of the compositional material is referred to as "C") granular form for the first form, and using a first temperature of about two hundred (200) degrees Celsius; the EVA melts in the hot mold and flows to the bottom side of the mold forming the harder frontal region 14 of the improved athletic cup 10, the first temperature is raised to the second temperature of about three hundred (300) degrees Celsius. In this embodiment of the method, the second portion of the compositional material (which may be the same material as the first portion of the compositional material, e.g., again EVA) may be in the form of 40 C granular EVA form, which after injection melts to form the resilient comfort edge 12, and the second temperature is lowered to a curing temperature for about one (1) minute. The region of contact or interface between the deposit of compositional material introduced in the first form (such as 75 C granular EVA) and the deposit of compositional material introduced in the second form (such as 40 C granular EVA) forms a transitory region 20.

In one embodiment, the hard frontal region 14 is made from granular EVA with a density of about 70 C. In the same or an alternate embodiment, the resilient comfort edge 12 is made from granular EVA with a density of about 40 C. The precise granular sizes or physical state of the moldable material may be varied in practice of other embodiments. Likewise, various other thermoplastic materials which are non-toxic and suitable for human contact may be used to form the improved athletic cup 10. As disclosed, an improved athletic cup 10 may be provided that is made of a single compositional material (such as EVA), yet having different physical properties (such as strength, softness, rigidity, resilience).

As one of the possible alternative methods, the different densities among the regions of the improved athletic cup 10 might be created during the manufacturing process by "foaming" the compositional material introduced into some locations (such as in the area of the resilient comfort edge 12 created by the second portion of compositional material), or "bubbling" air into or through such regions during the manufacturing process. In one embodiment, the density of the EVA material at the hard frontal region 14 and the resilient comfort edge 12 is varied through a dual density foaming process known to those skilled in the art.

The molding process creates a improved one piece athletic cup 10 that possess the requisite strength and hardness to protect the male groin area from injury in an athletic event while providing a comfortable, flexible fit to the body. The molding process creates regions of varying flexibility or rigidity throughout the one piece improved athletic cup. Further, the improved design is much lighter than the known art (approximately 53 g compared to 100 g). It should be understood that reference to a "single structure" or "one piece" construction does not necessarily mean that there is no line of demarcation between the regions of varying hardness and flexibility. Keeping this possibility of a line of demarcation in mind, the athletic cup 10 may be a "single structure", and also a "single composition" construction (possibly, although not necessarily containing lines of demarcation in the transitory regions 20), in which the device could conceptually (or even physically) broken into different structural segments, but which segments are created from the same basic compositional material (e.g., EVA or others).

While this disclosure has been described with respect to a limited number of embodiments, those skilled in the art, having benefit of this disclosure, will appreciate that other embodiments can be devised.

What is claimed is:

1. A method of manufacturing an athletic cup molded from a single compositional material comprising:

a. providing a granulated compositional material;

b. injecting a first portion of the compositional material into a mold preheated to a frontal region forming temperature under a first pressure and exposing the first portion of the compositional material to the frontal region forming temperature and the first pressure for a first time period;

c. injecting a second portion of the compositional material into a mold preheated to a resilient comfort edge forming temperature under a second pressure, and exposing the second portion of the compositional material to the resilient comfort edge forming temperature and the second pressure for a second time period;

d. bringing the mold containing the frontal region into contact with the mold containing the resilient comfort edge; and e. joining the frontal region with the resilient comfort edge by exposing the molds to a fusing temperature at a third pressure for a third time period.

2. The method of claim 1, further comprising the step of foaming the compositional material.

3. The method of claim 1, further comprising the step of coloring or dying at least one of the first portion of compositional material or the second portion of compositional material.

4. The method of claim 1 wherein the first portion of compositional material comprises 70 kg/m$^3$ density granular ethylene vinyl acetate copolymer.

5. The method of claim 1 wherein the second portion compositional material comprises about 40 kg/m$^3$ granular ethylene vinyl acetate copolymer.

6. The method of claim 1 wherein the frontal region forming temperature is two hundred (200) degrees Celsius, the first pressure is eight (8) Pascals, and the first period of time is two (2) minutes.

7. The method of claim 1 wherein the resilient comfort edge forming temperature is three hundred (300) degrees Celsius, the second pressure is thirteen (13) Pascals, and the second period of time is two (2) minutes.

8. The method of claim 1 wherein the fusing temperature is one hundred and seventy-five (175) degrees Celsius.

9. The method of claim 1 wherein the third pressure is thirteen (13) Pascals, and the third period of time is four (4) minutes.

10. An athletic cup for protecting a male human's genitals from traumatic impact manufactured by a process comprising the steps of:

a. providing a granulated compositional material;

b. injecting a first portion of the compositional material into a mold preheated to a frontal region forming temperature under a first pressure and exposing the first portion of the compositional material to the frontal region forming temperature and the first pressure for a first time period;

c. injecting a second portion of the compositional material into a mold preheated to a resilient comfort edge forming temperature under a second pressure, and exposing the second portion of the compositional material to the resilient comfort edge forming temperature and the second pressure for a second time period;

d. bringing the mold containing the frontal region into contact with the mold containing the resilient comfort edge; and e. joining the frontal region with the resilient comfort edge by exposing the molds to a fusing temperature at a third pressure for a third time period.

11. The athletic cup of claim 10, manufactured by a process further comprising the step of foaming the compositional material.

12. The athletic cup of claim 10, manufactured by a process further comprising the step of coloring or dying at least one of the first portion of compositional material or the second portion of compositional material.

13. The athletic cup manufactured by the process of claim 10 wherein the first portion of compositional material comprises 70 kg/m$^3$ density granular ethylene vinyl acetate copolymer.

14. The athletic cup manufactured by the process of claim 10 wherein the second portion compositional material comprises about 40 kg/m$^3$ granular ethylene vinyl acetate copolymer.

15. The athletic cup manufactured by the process of claim 10 wherein the frontal region forming temperature is two hundred (200) degrees Celsius, the first pressure is eight (8) Pascals, and the first period of time is two (2) minutes.

16. The athletic cup manufactured by the process of claim 10 wherein the resilient comfort edge forming temperature is three hundred (300) degrees Celsius, the second pressure is thirteen (13) Pascals, and the second period of time is two (2) minutes.

17. The athletic cup manufactured by the process of claim 10 wherein the fusing temperature is one hundred and seventy-five (175) degrees Celsius.

18. The athletic cup manufactured by the process of claim 11 wherein the third pressure is thirteen (13) Pascals, and the third period of time is four (4) minutes.

19. A method of manufacturing an athletic cup molded from a single compositional material comprising:

a. providing a granulated and foamed ethylene vinyl acetate copolymer;

b. injecting a first portion of the ethylene vinyl acetate copolymer having a density of 70 $kg/m^3$ into a mold preheated to two hundred (200) degrees Celsius under a pressure of eight (8) Pascals of pressure and heating the ethylene vinyl acetate copolymer in the mold for two (2) minutes;

c. injecting a second portion of ethylene vinyl acetate copolymer into a mold preheated to three hundred (300) degrees Celsius under a pressure of thirteen (13) Pascals, and heating the ethylene vinyl acetate copolymer in the mold for two (2) minutes;

d. bringing the molds containing the first portion and the second portions of ethylene vinyl acetate copolymer into contact; and e. joining the first portion and the second portions of ethylene vinyl acetate copolymer by exposing the molds to one hundred-seventy five (175) degrees Celsius under a pressure of thirteen (13) Pascal's for four (4) minutes.

* * * * *